United States Patent [19]

Pahlsson et al.

[11] Patent Number: 4,650,493

[45] Date of Patent: Mar. 17, 1987

[54] METHOD OF WASHING TEXTILE OBJECTS AND A DEVICE FOR PERFORMING THE METHOD

[75] Inventors: Sten-Erik G. Pahlsson; Börje Sandström, both of Ljungby, Sweden

[73] Assignee: A.B. Electrolux, Stockholm, Sweden

[21] Appl. No.: 597,211

[22] PCT Filed: Dec. 21, 1981

[86] PCT No.: PCT/SE81/00388

§ 371 Date: Aug. 18, 1982

§ 102(e) Date: Aug. 18, 1982

[87] PCT Pub. No.: WO82/02218

PCT Pub. Date: Jul. 8, 1982

Related U.S. Application Data

[63] Continuation-in-part of Ser. No. 413,360, Aug. 18, 1982, abandoned.

[30] Foreign Application Priority Data

Dec. 22, 1980 [SE] Sweden ..... 8009060

[51] Int. Cl.[4] ..... C11D 3/43; D06L 1/04; D06L 1/08; D06L 1/10

[52] U.S. Cl. ..... 8/142; 8/139.1; 252/162; 252/170; 252/171; 252/172; 252/174.21; 252/550; 252/559

[58] Field of Search ..... 8/142; 252/559, 170, 252/171

[56] References Cited

U.S. PATENT DOCUMENTS

| | | | |
|---|---|---|---|
| 3,635,656 | 1/1972 | Piepmeyer | 8/142 |
| 3,689,211 | 9/1975 | Giampalmi et al. | 8/142 |
| 4,115,061 | 9/1978 | Grunewalder | 8/142 |

OTHER PUBLICATIONS

Prince, ed. *Microemulsions*, Academic Press Inc., N.Y., 1977, pp. 31, 92.

*Primary Examiner*—Dennis L. Albrecht
*Attorney, Agent, or Firm*—Alfred E. Miller

[57] ABSTRACT

A method of washing textile objects comprises prewashing in a liquid composed of an organic dissolvent, preferably perchloroethylene, main washing in a liquid composed of a mixture of the organic dissolvent, a tenside and water, and at least two subsequent rinsing period, the objects being spin dried after each washing or rinsing period. The main-washing liquid is composed of a microemulsion whose water contents amount to between 4 and 30, preferably 10–30, percentage by weight and the first rinsing is made in a liquid composed of the organic dissolvent to which tenside has been added. A device for performing the method comprises three receptacles (11, 26, 32) for storing microemulsion, perchloroethylene, and used rinsing liquid from the first and preferably also from the second rinsing, respectively. The three receptacles communicate with a container (10) for the objects to be washed, which container can be supplied with tenside and water, respectively, from a dosing device (56).

7 Claims, 1 Drawing Figure

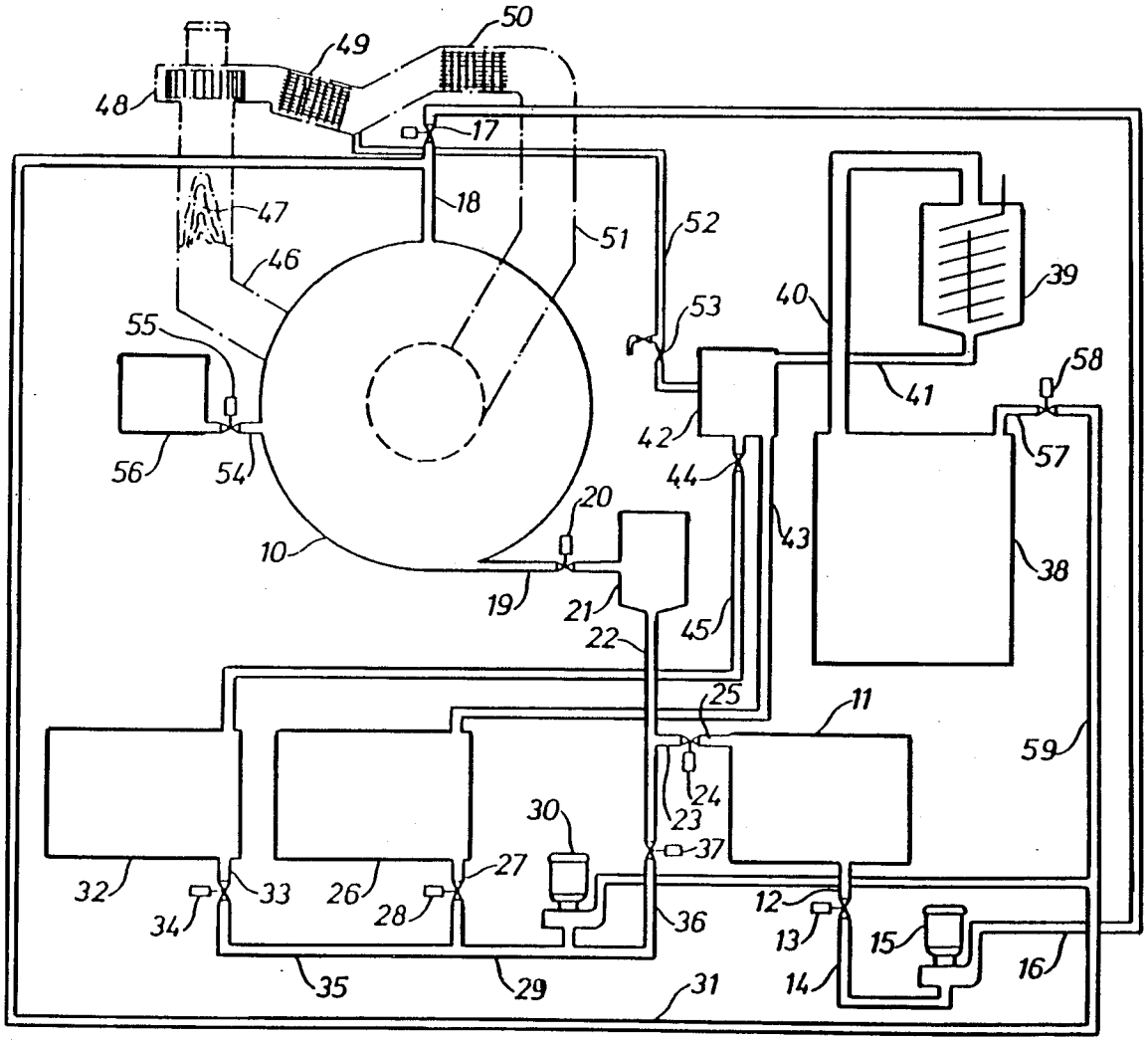
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59

METHOD OF WASHING TEXTILE OBJECTS AND A DEVICE FOR PERFORMING THE METHOD

This application is a continuation-in-part of application Ser. No. 413,360, filed Aug. 18, 1982, now abandoned.

This invention relates to a method of washing textile articles comprising a washing period during which the articles are treated in a washing liquid composed of an organic dissolvent, preferably perchloroethylene, water and tenside, the liquid forming a microemulsion.

Traditionally, textile clothes can be cleaned either by washing in water or by dry cleaning. Water cleaning is active in normally soiled clothes (pigment dirt) whereas dry cleaning is effective for clothes soiled by oil, grease and the like. Some clothes which are very dirty and soiled by oil, for example garage workers' overalls, often need both washing in water and dry cleaning to become satisfactorily clean.

To be forced to use both washing in water and dry cleaning for cleaning working clothes is a procedure which is both time-consuming and expensive. Furthermore, washing in water requires a treatment temperature during the washing period which amounts to 60° C., or more. This involves a high energy consumption. Therefore, it has been investigated whether it is possible in some way to combine the two washing methods so as to make the washing process more effective and less time consuming. These investigations have led to active detergents composed of mixtures of a tenside, which is normally used for washing in water, an organic dissolvent of the type used for dry cleaning, and water. If, for instance, perchloroethylene is chosen as organic dissolvent, by suitable composition of the said components mixtures are obtained in which the water acts as a microemulsion in perchloroethylene. Characteristic of such a microemulsion is that it is thermodynamically stable, i.e. it is stable without stirring, within a predetermined temperature range, usually from room temperature up to about 30° C. The microemulsion is also characterized by comparatively high water content, up to 20–30 percentage by weight. The tenside of the emulsion is in principle an emulgator consisting of non-ionic surface active compounds to which, if desired, small quantities of anionic compounds have been added. The tenside also includes a solubility agent which increases the effectivity of the washing liquid on dirt which is soluble in water. Examples of suitable tensides will be set forth hereinafter.

The microemulsions have proved to have a very good cleaning effect on heavily soiled working clothes, both for dissolving pigment dirt and for removing impurities based on mineral oils. Furthermore, the washing process can be performed at room temperature. Thus, there is no need for heating the washing liquid. Hence, the process will be more energy-saving than if common washing in water had to be included.

The invention, which is based on the findings related above, has for its object to provide a method of washing by which textile clothes, for example heavily soiled working clothes, can be freed of pigment dirt and oils in a single process at low temperature, preferably within the range of 20°–30° C. Microemulsion is a comparatively expensive detergent and therefore it is desired to be able to re-utilize it in several successive washings. Another object of the invention is to make such repeated use possible. A further object is to provide a device for performing the said method of washing. The present invention gives a better result than other known arrangements by creating a microemulsion for better washing while preventing high viscous precipitations which will adhere to the fibres of the fabrics being washed.

A description of the invention is set forth in detail hereafter and in that connection technical aspects relating to the method will be discussed and a device be described with reference to the accompanying drawing the single FIGURE of which shows the schematic construction of a washing machine for microemulsion cleaning.

As pointed out above, by washing in microemulsion very good cleaning results are obtained which otherwise, at best, could be reached only by both dry cleaning and cleaning in water. However, when it comes to utilizing the microemulsion washing in practice, several problems arise which the invention solves. One such problem is the fact that the microemulsion, due to its re-utilization, is gradually depleted of tenside and water. These components of the emulsion therefore must be re-dosed at appropriate times. For instance, it may be necessary to add tenside before each new washing process. Another problem is that the microemulsion will successively be mingled with pigment dirt and particles of dye, and this increases the risk of greying in the case of several repeated uses. A solution to this problem is to filter the microemulsion, for example through filter paper, after each washing process.

To prevent a situation wherein the microemulsion is unnecessarily loaded with impurities based on mineral oils, a pre-washing in perchloroethylene is proposed. To enhance the cleaning effect on water-based dirt also tenside can be added, as well as small quantities of water. In the following examples, main-washing water and tenside will be bound in the clothes. Thus, the microemulsion will be short or depleted of these components. The said dosing of tenside and water to the pre-washing liquid counteracts this depletion. The pre-washing must be followed by spin drying of the clothes so that most of the impurities are separated together with the pre-washing liquid. The latter can, in known manner, be purified from the impurities by distillation.

After washing in microemulsion, the clothes have to be rinsed at least once, and preferably twice. The microemulsion washing as well as the rinsings must be followed by spin drying cycles, which are extremely important for the final washing result. The rinsings are preferably made in pure perchloroethylene. However, after washing in microemulsion, the clothes will contain microemulsion residues which in the event that rinsing is made in pure perchloroethylene can be precipitated in a viscous form, which is extremely difficult to remove. To avoid this, tenside is added to the rinsing liquid in the first rinsing after the microemulsion washing. The quantity of tenside can preferably be 0.5 percentage by weight. The second rinsing, however, can be made in pure perchloroethylene, because then the microemulsion residues are so small that the risk of precipitation thereof is insignificant.

From a rational point of view, it is advantageous if the rinsing liquid of the first rinsing, which is mainly perchloroethylene, can be used as pre-washing liquid in connection with the pre-washing of a subsequent washing process. The contents of microemulsion, after the first rinsing, is estimated to be about 4%. To avoid dissolution, i.e. precipitations in viscous form of the microemulsion, tenside of about 0.5% has been added already during the rinsing process, as stated above. This liquid can be used as pre-washing liquid without any further addition of tenside.

Tests have been made in a launderometer with sample pieces of cotton and polyester/cotton, respectively, with and without finish, which have been soiled with soot and oil. The washing program includes pre-washing, followed by washing in microemulsion and two rinsings. Cleaning and greying were measured by reflexion L in a Hunterlab spectrophotometer. The cleaning is stated as a percentage determined in accordance with the following:

$$\text{Cleaning in\%} = [(L_{washed} - L_{soiled})/(L_{clean} - L_{soiled})] \cdot 1000$$

Greying is stated as a reduction of the reflexion L, i.e.

$$\Delta L = L_{washed} - L_{not\ washed}$$

The launderometer washings were made at 25° C.

The pre-washing went on for 5 min. followed by washing in microemulsion for 30 min. after which two rinsings, each during 5 min., and drying between filter papers in room temperature accomplished the washing process.

The washing results appear in the following table in which are also inserted comparative values from washings made in a corresponding way with the sample pieces only treated in perchlorethylene. The table comprises results from washings in which two different microemulsions and three tensides have been used. All percentages relating to amounts of microemulsion, tenside etc. are by weight.

The composition of the two microemulsions are as follows:

| Microemulsion 1 | | Microemulsion 2 | |
|---|---|---|---|
| Perchlorethylene | 79 weight % | Perchlorethylene | 70 weight % |
| Water | 15 weight % | Water | 15 weight % |
| Tenside 1 | 6 weight % | Tenside 2 | 15 weight % |

From the results it appears that with respect to cleaning as well as to greying both of the microemulsion alternatives are better than treatment in pure perchloroethylene. Particularly the problems of greying become much less in microemulsion washing.

Also tests on an industrial scale have been made with microemulsion washing in accordance with the following program

| Period | Description | Time in min. |
|---|---|---|
| 1 | Pre-washing (per. + 0,5% tenside) | 8 |
| 2 | Spin drying | 4 |
| 3 | Micro emulsion washing | 10 |
| 4 | Spin drying | 4 |
| 5 | Rinsing (per. + 0,5% tenside) | 6 |
| 6 | Spin drying | 2 |
| 7 | Rinsing (pure per.) | 4 |
| 8 | Spin drying | 4 |
| 9 | Drying and venting, emptying | abt. 24 |
| Total | | 66 |

Both the launderometer tests and the industrial tests have shown that the microemulsion washing is very effective as concerns removal of pigment and oil, as well as sweat.

| | Example | | | | | |
|---|---|---|---|---|---|---|
| | 1 | 2 | | 3 | | |
| | | Tenside | | | | |
| | | Tenside 1 | | Tenside 2 | | |
| Pre-washing | Perchlorethylene | Per. + 4% microem. 1 + 0.5% Tenside 1 | | Per. 4% microem. 2 | | |
| Main washing | " | Microemulsion 1 | | Microemulsion 2 | | |
| Rinsing 1 | " | Per. + 0.5% Tenside 1 | | Per. +6% Tenside 3 | | |
| Rinsing 2 | " | Perchlorethylene | | Perchlorethylene | | |
| | Cleaning % | Greying ΔL | Cleaning % | Greying ΔL | Cleaning % | Greying ΔL |
| Cotton soot/oil | 10.8 | 8.4 | 17.3 | 0.3 | 31.6 | 0.2 |
| D/B without fio* | 19.0 | 6.8 | 39.7 | 0.3 | 51.0 | 0 |
| D/B with fio* | 25.5 | 5.1 | 36.1 | 0.9 | 46.4 | 0 |

*fio = finish soot/oil
Bath ratio 1:50
Load 100 g of glass balls

The composition of the tensides is as follows:

| | Tenside 1 Weight % | Tenside 2 Weight % |
|---|---|---|
| Ca—dodecylbensensulphonate | 30 | — |
| Na—dodecylsulphate | — | 0.5 |
| Nonylphenol + 8 EO | 10 | 98.4 |
| Nonylphenol + 20 EO | 30 | — |
| n-butanol | 30 | — |
| Water | — | 1.1 |

EO in the table represents ethylene oxide.

Tenside 3 and Tenside 2 are related such that Tenside 3+0.5% natriumdodecylsulphate equals Tenside 2.

The construction of a washing machine for performing the washing method in accordance with the invention will be outlined with reference to the FIGURE. The machine comprises a washing drum, which is rotatably mounted in a container 10. The drum is connected to a motor, which drives the drum on one hand with a washing speed of rotation and on the other hand with an increased spin drying speed of rotation. Connected to the container 10 are several receptacles, in which are stored the washing and rinsing liquids to be used. Thus, a receptacle 11 for microemulsion is connected to the washing drum by means of a conduit 12, a valve 13, a conduit 14, a pump 15, a conduit 16, a valve 17 and a conduit 18. The container 11 is further connected to the outlet 19 by means of a valve 20, a needle trap 21, a conduit 22, a conduit 23, a valve 24 and a conduit 25. A receptacle 26 for perchloroethylene is connected to the container 10 by means of a conduit 27, a valve 28, a conduit 29, a pump 30, a conduit 31 and the conduit 18. Another receptacle 32 for perchloroethylene is connected to the conduit 29 and thus also to the container 10 by means of a conduit 33, a valve 34 and a conduit 35. Further, the receptacle 26 is connected to the outlet 19 of the container 10 by means of a conduit 36 connected to the conduit 29 and a valve 37 connected to the conduit 22.

For recuperation of the perchloroethylene contained in impurified rinsing liquids, a distiller 38 is provided and a cooler 39 therefor, to which it is connected by means of a conduit 40. The cooler 39 is connected via a conduit 41 to a water separator 42 which through a conduit 43 is connected to the receptacle 26 and through a valve 44 and a conduit 45 is connected to the receptacle 32. By the connection to the distiller system the receptacle 26 is continuously supplied with pure perchloroethylene whereas the receptacle 32 can be refilled by means of the valve 44, when necessary.

For drying and ventilation of the laundry the container 10 is connected to a dryer system comprising a conduit 46 including a nap filter 47, a fan 48, a cooler 49, a heater 50 and a conduit 51. The perchloroethylene recuperated in the dryer system can by means of a conduit 52, with a valve 53, be conveyed to the water separator 42 and thence to the receptacles 26 and 32. Finally, the container 10 is through a conduit 54 and a valve 55 connected to a dosing device 56 for tenside and water, respectively. Further, the distiller 38 is connected to the conduit 31 through a conduit 57, a valve 58 and a conduit 59.

The function of the washing machine will be described hereinafter with reference to the above program for washing in microemulsion tested on an industrial scale. According to this program, there is at first a pre-washing in perchloroethylene. The container 10 is thus connected to the receptacle 26 from which liquid is supplied. It is assumed that this washing process succeeds several washing processes of similar type. The liquid in the receptacle 26 has thus been utilized as rinsing liquid in the first rinsing after the microemulsion washing and hence it contains microemulsion residues and tenside. As already said pure perchloroethylene is continuously supplied to the receptacle 26 from the distiller system. Therefore it is necessary also to portion from the dosing device 56 to the pre-washing liquid in the first place tenside and possibly also water. When pre-washing has been accomplished, the pre-washing liquid is pumped by the pump 30 through the outlet 19, valve 20, needle trap 21, conduit 22, valve 37, conduit 36, conduit 31, conduit 59, valve 58 and conduit 57 to the distiller 38. After spin drying, microemulsion is supplied from the receptacle 11, and the main washing starts. When the washing period is completed the microemulsion is conveyed back to the receptacle 11, and this reconveyance continues also during the spin drying period. In the subsequent first rinsing the laundry will contain residues of microemulsion and thus the rinsing liquid supplied from the receptacle 26 may need an additional supply of tenside so that there will be no precipitation of the microemulsion residues. The rinsing liquid supplied from the receptacle 26 contains partly microemulsion, and partly tenside and water. Dependent on the quantities of the components concerned it may be necessary to supply additional tenside and possibly also water. After the rinsing period, the rinsing liquid is conveyed back to the receptacle 26.

The second rinsing is made in pure perchloroethylene supplied from the receptacle 32. At this stage the residues of microemulsion in the laundry are so small that it is not necessary to add tenside in order to avoid high-viscous precipitations. After rinsing, the rinsing liquid is conveyed to the receptacle 26 to be used as rinsing liquid in subsequent first rinsings. After spin drying, the drying system is operated and the vapors of perchloroethylene, thus generated, are cooled in the cooler 49 and the condensate is conveyed by means of the conduit 52, water separator 42 and conduit 43 to the receptacle 26.

The microemulsion will be successively mingled with dirt and dye particles as well as with impurities based on oil. Since the microemulsion is used unchanged, washing after washing it has therefore to be exchanged after a number of washings. For this purpose the receptacle 11 can have a drain tap, as well as a filling device.

The receptacle 26 is supplied, on one hand with pure perchloroethylene from the distiller 38, and on the other hand with substantially pure perchloroethylene taken from the receptacle 32, and used as rinsing liquid in the second rinsing. Further, liquid is taken from the receptacle 26 and is used as rinsing liquid for the first rinsing, whereafter it is returned to the receptacle. Finally, liquid is taken from the receptacle 26 to be used as pre-washing liquid. The latter liquid, however, is after the pre-washing transferred to the distiller. It would appear from the above that it may be difficult to estimate beforehand the composition of the liquid in the receptacle 26, after several washing periods. One way of solving this problem is to analyze at suitable intervals the liquid with respect to the contents of tenside and water so that incurred losses can be compensated through the dosing device 56, and thus the risk of high-viscous precipitations can be eliminated. If the demand for accuracy is not too high, automatic analyzing equipment can be used. This function, as well as the function of pumps, valves and the like included in the machine, can be controlled by the program device.

We claim:

1. A method of washing textile articles comprising the steps of: providing a pre-washing period during which the textiles are treated in a liquid composed of an organic solvent perchloroethylene to which a tenside has been added, a main washing period during which the articles are treated in a liquid including a mixture of organic solvent, a tenside and water, and at least two subsequent rinsing periods during which said textile articles are treated in a liquid consisting of an organic solvent, the contents of said tenside of the said pre-washing liquid constituting 0.2–3 percentage by weight, said main washer liquid being composed of a microemulsion with a water content of between 10–30 percentage by weight, and the first rinsing being made in a liquid composed of an organic solvent to which a tenside has been added, the contents of said tenside being 0.2–3 percentage by weight.

2. A method as claimed in claim 1 further including the step of adding a small quantity of water to said pre-washing liquid.

3. A method as claimed in claim 2 wherein the contents of tenside and water are ensured by adding of an appropriate quantity of microemulsion used for the main washing.

4. A method as claimed in claim 1 wherein the liquid of said first rinsing is separated to be used as pre-washing liquid in the next following washing process.

5. A method as claimed in claim 7 wherein said microemulsion is filtered before being reused.

6. A method as claimed in claim 5 wherein said microemulsion is filtered through a filter paper.

7. A method as claimed in claim 1 wherein said first rinsing is made in a liquid whose contents of tenside are 0.4–0.8 percentage by weight.

* * * * *